US006051354A

United States Patent [19]

Veregin et al.

[11] Patent Number: 6,051,354

[45] Date of Patent: Apr. 18, 2000

[54] COATED CARRIER

[75] Inventors: Richard P. N. Veregin, Mississauga; Gerald R. Allison, Oakville; Gregory J. Kovacs, Mississauga; Paul J. Gerroir, Oakville, all of Canada

[73] Assignee: Xerox Corporation, Stamford, Conn.

[21] Appl. No.: 09/302,544

[22] Filed: Apr. 30, 1999

[51] Int. Cl.[7] ..... G03G 9/00

[52] U.S. Cl. ..... 430/108; 430/137

[58] Field of Search ..... 430/108, 137

[56] References Cited

U.S. PATENT DOCUMENTS

| | | | |
|---|---|---|---|
| 3,939,086 | 2/1976 | Hagenbach | 252/62.1 P |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,433,040 | 2/1984 | Niimura et al. | 430/109 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,194,360 | 3/1993 | Ohmura et al. | 430/137 |
| 5,223,368 | 6/1993 | Ciccarelli et al. | 430/110 |
| 5,324,613 | 6/1994 | Ciccarelli et al. | 430/110 |
| 5,350,656 | 9/1994 | Kouno et al. | 430/108 |
| 5,376,488 | 12/1994 | Ohmura et al. | 430/106.6 |
| 5,376,494 | 12/1994 | Mahabadi et al. | 430/137 |
| 5,683,844 | 11/1997 | Mammino | 430/106.6 |
| 5,935,750 | 8/1999 | Barbetta et al. | 430/106.6 |

*Primary Examiner*—Mark Chapman
*Attorney, Agent, or Firm*—E. O. Palazzo

[57] ABSTRACT

A process for the preparation of carrier comprised of mixing in a high shear device a carrier core and a carrier coating.

45 Claims, No Drawings

COATED CARRIER

PENDING APPLICATIONS AND PATENTS

Illustrated in copending applications and patents U.S. Ser. No. 09/140,524; U.S. Pat. No. 6,004,712; U.S. Ser. No. 09/140,439; U.S. Pat. No. 5,935,750, and U.S. Pat. No. 5,945,244, the disclosures of each of which are totally incorporated herein by reference, are carrier particles comprised, for example, of a core with coating thereover of polystyrene/olefin/dialkyl aminoalkyl methacrylate, polystyrene/methacrylate/dialkylaminoalkyl methacrylate, and polystyrene/dialkyl aminoalkyl methacrylate. More specifically, there is illustrated in copending application U.S. Ser. No. 09/140,524 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in U.S. Pat. No. 6,004,712a carrier comprised of a core and thereover a polymer or polymers of (1) methylmethacrylate and a monoalkyl aminoalkyl methacrylate, or (2) a polymer or polymers of methylmethacrylate and dialkylaminoalkyl methacrylate; in copending application U.S. Ser. No. 09/149,439 a carrier comprised of a core and a polymer coating of (1) styrene/monoalkylaminoalkyl methacrylate or (2) styrene/dialkylaminoalkyl methacrylate; in U.S. Pat. No. 5,935,750 a carrier comprised of a core and a polymer coating containing a quaternary ammonium salt functionality; and in U.S. Pat. No. 5,945,244 is a carrier comprised of a core, and thereover a polymer of styrene, an olefin and a dialkylaminoalkyl methacrylate.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles and processes thereof. More specifically, the present invention relates to compositions, especially carrier compositions comprised of a core and thereover a polymer or mixture of polymers, and wherein the carriers are prepared by the utilization of high shear mixers to enable, for example, smooth coatings on the carrier and complete, or substantially complete coating of the carrier core, thereby resolving or minimizing problems encountered with the prior art processes wherein kilns are, for example, used and which kilns are free of impellers and thus high shear forces are not believed to be selected.

In embodiments of the present invention, the carrier particles are comprised of a core with a first polymer coating thereover of, for example, a fluoropolymer, a styrene polymer, a styrene acrylate, a styrene methacrylate, polymethylmethacrylate, the polymers of the above recited copending applications, such as terpolymers, such as terpolymers of styrene, butadiene and dimethylaminoethyl methacrylate, terpolymers of styrene, butadiene and alkyl aminoethyl methacrylates or acrylates with alkyl amine groups higher in carbon chain length than methyl, such as t-butylaminoethyl methacrylate, diethylaminoethyl methacrylate, diisopropylaminoethyl methacrylate, and the like. The carrier may include the first polymer coating thereover in admixture with other suitable polymers, and more specifically, with a suitable known second polymer, such as a fluoropolymer, polymethylmethacrylate, poly (urethane), especially a crosslinked polyurethane, such as a poly(urethane)polyester and the like, and moreover, the polymer coating may contain a conductive component, such as carbon black, and which conductive component is preferably dispersed in the polymer coating. With the conductive component, there may be enabled carriers with increased developer triboelectric response at relative humidities of from about 20 to about 90 percent, improved image quality performance, excellent high conductivity ranges of from about $10^{-10}$ to about $10^{-7}$(ohm-cm)$^{-1}$, a triboelectrical charge, for example a carrier triboelectric charge range of from about a plus (positive charge) 20 to about 150 microcoulombs per gram, and preferably from about a positive 20 to about a positive 90 microcoulombs per gram, wherein the carrier charge is stable over extended time periods. Stable refers, for example, to minimal or substantially no changes in the carrier characteristics, for example, the triboelectric charge will not usually vary by more than 10 percent after being utilized for extended cycle times, such as from about 10,000 developed prints to about 50,000 developed prints in a xerographic or digital imaging apparatus.

The carrier particles of the present invention can be selected for a number of different xerographic copiers and printers, such as high speed color xerographic copiers, printers, digital copiers, and more specifically, wherein colored copies with excellent image resolution and substantially no background deposits are achievable in copiers, printers, digital copiers, and the combination of xerographic copiers and digital systems. Developer compositions comprised of the carrier particles illustrated herein and prepared, for example, by a dry or solution coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core, the type and amount of the optional conductive component selected and the high shear mixing apparatus used.

PRIOR ART

Carrier particles for use in the development of electrostatic latent images and processes thereof are described in many patents including, for example, U.S. Pat. No. 3,590,000. These carrier particles, usually prepared in kilns can contain various cores, including steel, with a coating thereover of fluoropolymers, and terpolymers of styrene, methacrylate, and silane compounds.

There are illustrated in U.S. Pat. No. 4,233,387, the disclosure of which is totally incorporated herein by reference, coated carrier components prepared for example in kilns, for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 20 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 5 minutes to about 120 minutes, enabling the resin particles to melt and fuse on the carrier core.

There can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of, for example, from a positive triboelectric charge of about 20 to about 150, preferably about 20 to about 90, and more specifically, about 30 to about 70 microcoulombs per gram on the carrier particles as preferably determined by the known Tribo Blow-off Faraday Cage technique. Thus, the developers of the present invention can be formulated with conductivity values in a certain range with different triboelectric charging characteristics by, for example, maintaining the same total coating weight on the carrier particles, and wherein a conductive component such as carbon black can be avoided and wherein the carrier core contains a smooth even coating of polymer, or polymer mixtures.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof.

With further reference to the prior art, carriers obtained by applying insulating resinous coatings to porous metallic carrier cores using solution coating techniques are undesirable from many perspectives. For example, the coating material does not evenly coat the core. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses.

Other U.S. patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

The appropriate components of the copending applications and above patents may be selected for the carriers of the present invention in embodiments thereof.

SUMMARY OF THE INVENTION

It is a feature of the present invention to provide toner and developer compositions with carrier particles containing a polymer, or polymer coating.

In another feature of the present invention there are provided dry coating processes for generating relatively smooth, or substantially smooth carrier polymer coatings and wherein the resulting carriers possess substantially constant conductivity parameters.

In yet another feature of the present invention there are provided high shear mixing processes for generating carrier particles of substantially constant conductivity parameters, and excellent triboelectric charging values.

In aspects thereof the present invention relates to processes for the preparation of carrier, and more specifically wherein the processes are accomplished in high shear mixers, in extruders, and the like to enable evenly coated carriers with smooth surfaces. Smooth and evenly refers for example, to the surface texture of the carrier after coating, as can be observed for example, by Scanning Electron Microscope examination, and wherein all low and high points of the rough carrier surface are fully, or substantially fully and completely coated to cover the underlying carrier core. Coating weights can vary, for example, from about 0.3 weight percent to about 10 weight depending on the carrier morphology and size, and the desired charge and conductivity.

Aspects of the present invention relate to a process for the preparation of carrier comprised of the mixing in a high shear device or apparatus, such as a high shear mixer a carrier core and a carrier coating; a process for the preparation of carriers comprised of the mixing in a high shear mixer carrier cores and carrier coatings; a carrier process where the high shear mixer is an extruder, a Haake melt or a Banbury mixer; a process where the high shear mixer is a mixing device containing conveying screws; a process where the high shear mixer is a mixing device with an impeller; a process wherein the high shear mixer is operating at from about 5 to about 150 rpm; a process wherein the high shear mixer is operating at from about 5 to about 150 rpm, and wherein the mixture is heated at a temperature of from about 100 to about 500° C.; a process wherein the high shear mixer is operating at from about 5 to about 150 rpm, and wherein the mixture is heated at, for example, (throughout for ranges such as speed, temperatures) a temperature of from about 100 to about 500° C. followed by separating the resulting coated carrier; a process wherein the high shear mixer is operating at from about 5 to about 150 rpm, and wherein the mixture is heated at a temperature of from about 100 to about 500° C. followed by separating the resulting coated carrier and which carrier is at a temperature of from about 50 to about 400° C.; a process wherein the high shear mixer is operating at from about 5 to about 150 rpm, wherein the mixture is heated at a temperature of from about 100 to about 500° C. followed by separating the resulting coated carrier and which carrier is at a temperature of from about 50 to about 400° C.; thereafter subjecting the coated carrier to sieving and wherein the sieve size is from about 50 to about 300, or about 100 to about 200 microns in diameter;

a process wherein the coating is a polymer; a process wherein the coating is comprised of a mixture of polymers; a process wherein the coating is a styrene polymer; a process wherein the coating (carrier) is a fluoropolymer; a process wherein the coating is a styrene acrylic; a process wherein the coating is a styrene methacrylic; a process wherein the coating is polymethylmethacrylate; a process wherein the polymer coating weight is from about 0.1 to about 20, or from about 1 to about 4 weight percent, and the carrier size is from about 30 to about 200, or from about 50 to about 175 microns in volume average diameter; a process wherein the polymer coating weight is from about 0.3 to about 20 weight percent; a process wherein the polymer contains a conductive component; a process wherein the conductive component is a metal oxide, or is carbon black; a process wherein the carrier conductivity ranges from about $10^{-15}$ mho/cm to about $10^{-6}$ mho/cm; a process wherein the carrier core is a metal, a metal oxide, a ferrite, or mixtures thereof, or other known carrier cores; a process wherein the carrier core is a strontium ferrite; a process for the preparation of a developer comprising mixing the carrier generated in a high shear device and toner; a process wherein the toner is comprised of thermoplastic resin and colorant; a process wherein the colorant is a pigment, or a dye; a process wherein there is added to the mixing device a second polymer; a process wherein the second polymer is a fluoropolymer, a styrene polymer, a styrene acrylate copolymer, or a styrene methacrylate copolymer; a process wherein the second polymer is comprised of a polyurethane, or polymethylmethacrylate; a process wherein the core is a metal of spherical steel or atomized steel, a metal oxide of magnetite, a ferrite of Cu/Zn-ferrite, Ni/Zn-ferrite, Sr (strontium)-ferrite, or Ba-ferrite; processes comprising mixing a carrier core, with a suitable size, such as from about 30 to about 200 microns, and more specifically, from about 30 to about 75 microns in average volume diameter, and which core was obtained from, for example, PowderTech Inc., and a carrier coating in a high shear mixing device, such as a Haake Torque Rheometer, a melt mixing device providing high shear, available from Haake Buchler Instruments, or an extruder, such as a single screw or a twin screw extruder, like for example a ZSK 30 extruder available from Krupp, Werner and Pfleiderer. The high shear devices operate at various mixing speeds, for example from about 2 to about 100 revolutions per minute and more specifically from about 5 to about 50 revolutions per minute, with the mixing time in batch mode, or average residence time in the continuous feed mode, being for example from about 2 to about 100 minutes, and more specifically from about 4 to about 60 minutes. The impellers to apply the high shear can be of any configuration that generates high shear, but are preferably conveying screws. Examples of high shear mixing devices are Haake Buchler Instruments Torque Rheometers, single screw extruders, twin screw extruders, with either counter-rotating or co-rotating screws, as for example a ZSK 30 extruder with counter-rotating screws available from Krupp, Werner and Pfleiderer, super compounders, or a Banbury Mixers. Any other suitable high mixing device applying high shear, or employing an impeller may also be utilized. The high shear mixing device may be operated with vacuum applied or at ambient pressure.

The amount of high shear generated for example by an impeller can be controlled by measuring the torque applied to the impeller. The applied torque that characterizes a high shear is for example about equal to or about greater than 1 Newton-meter, and preferably greater than or equal to about 2 Newton-meters, for example about 2 to about 25. The high shear mixing device may be operated at ambient pressure, or with a vacuum applied ranging, for example, from about ambient pressure down to about 1 Torr. Heating is applied while mixing and which heating is at a temperature of, for example, of from about 100° C. to about 500° C.

Processes of the present invention comprise, for a batch mode operation, adding a core and coating preblend to high shear melt mixing device, such as a Haake Torque Rheometer, wherein a high shear mixing device is a device that has one or more impellers, but preferably two impellers, operating from about 2 rpm to about 150 rpm, and preferably from about 5 to 50 rpm (revolutins per minute). The carrier core and a carrier coating amounts are selected to fill from about 50 percent to 100 percent (weight percent) and preferably close to about 100 percent of the melt mixing chamber in the batch mixer, to produce the highest shear, while the amount of coating varies from about 0.3 weight percent to 8 weight percent of the core. Heating is applied while mixing and which heating is at a temperature, for example, of from about 100 to about 500° C., and preferably wherein a temperature profile heating sequence is selected as indicated herein, where the initial temperature is close to or above the glass transition, or melt temperature of the polymer, and is decreased in such a way as to obtain maximum shear as the mixing progresses. While the mixing temperature profile depends on the polymer utilized, a typical reaction profile begins at about 205° C. for 5 minutes, then is lowered to about 190° C. for a further about 10 to about 25 minutes and wherein the melt mixer impeller rpm is from about 2 rpm to about 100 rpm, and preferably from about 5 to about 50 rpm.

For continuous mode operation the process of the present invention can comprise adding a core and coating or mixture of coatings throughout preblend to a high shear melt mixing device, such as a Haake Torque Rheometer with a extruder extension, or preferably to an extruder melt mixing device. The preblended carrier core and a carrier coating amounts are selected to fill from about 20 percent to 90 percent, and preferably from about 40 percent to 70 percent of the melt mixing chamber, with a preblend feed rate of from 1 pounds to about 100 lbs/hour, depending on the size of the extruder, the geometry of the screws, the rpm of the mixing impeller and the desired shear, while the amount of coating varies from about 0.3 weight percent to 8 weight percent of the core. Heating is applied while mixing and which heating is at a temperature, for example, of from about 100 to about 500° C., and preferably wherein a temperature profile heating sequence is selected as indicated herein, where the initial temperature is close to or above the glass transition temperature, or melt temperature, of the polymer, and is decreased in such a way as to obtain maximum shear as the mixing progresses. While the mixing temperature profile depends on the polymer or polymers utilized, a typical reaction profile begins with the first zones of the extruder set at 260° C., then lowering the temperature gradually at succeeding zones of the extruder as, for example, to 205° C. for the last four zones of the extruder, and wherein the melt mixer impeller rpm is from about 2 rpm to about 150 rpm, and preferably from about 5 to about 50 rpm.

The hot to warm, from about 50° C. to 400° C., resulting coated carrier is then removed or exits from the melt mixer, followed by screening through a sieve. The preferred screen size of the sieve is from about 50 μm to about 300 μm, and preferably from about 70 μm to about 150 μm, and may include the application of an air flow, vacuum, or vibration. No, or minimal buildup of polymer resulted on the mixer walls, as the shear from the mixer continually cleans the surfaces of the extruder or Haake mixer, and the polymer was permanently adhered to the carrier core.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also, of value with regard to the carrier core properties are, for example, suitable magnetic characteristics that will permit magnetic brush formation in magnetic brush development processes; and also wherein the carrier cores possess desirable mechanical aging characteristics; and also, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite containing, for example, about 14 percent strontium oxide and 86 percent iron oxide and available from Powdertech Corporation, and Ba-ferrite, magnetites, available for example from Hoeganaes Corporation (Sweden), nickel, mixtures thereof, and the like. Preferred carrier cores include ferrites, and sponge iron, or steel grit with an average particle size diameter of from about 30 microns to about 200 microns.

Polymer coating examples are as indicated herein, such as fluoropolymers, like polyvinylidene fluoride, polyvinylfluoride, trifluoroethylmethacrylate, trifluoroisopropyl methacrylate, trifluorobutylmethacrylate, or other halopolymers, such as polyvinylchloride, styrene polymers, halogenated styrene polymers, polyurethanes, polyamides, polyimides, polystyrene acrylates, polystyrene methacrylates, organosilanes, silanes, polymethylmethacrylates, polybutylmethacrylate, and mixtures thereof, and in embodiments the coatings of copending applications recited herein. Specific polymers that may be utilized include a monoalkyl, or dialkyl amine, such as a dimethylaminoethyl methacrylate, diethylaminoethyl methacrylate, diisopropylaminoethyl methacrylate, or t-butylaminoethyl methacrylate, and the like; and copolymers thereof. Specific examples of copolymer coatings are poly(styrene/dimethyl aminoethyl methacrylate), poly (styrene/tertiary-butylaminoethyl methacrylate), poly (styrene/diethyl aminoethyl methacrylate), poly(styrene/diisopropylaminoethyl methacrylate), poly(methyl methacrylate/dimethylaminoethyl methacrylate), poly (methyl methacrylate/tertiary-butylaminoethyl methacrylate), poly(methyl methacrylate/diethylaminoethyl methacrylate), poly(methyl methacrylate/diisopropylaminoethyl methacrylate), copolymers of methyl methacrylate with other monoalkyl or dialkylaminoethyl methacrylates, wherein alkyl contains, for example, from about 1 to about 25, and preferably from 1 to about 10 carbon atoms, such as methyl, ethyl, n-propyl, butyl, isopropyl, pentyl, decyl, pentadecyl, eicosyl and pentacosyl, and the like with methyl, ethyl, and isopropyl being preferred. These polymers may be coated with from about 0.2 percent by weight to 20 percent by weight, but preferably from 0.5 percent by weight to 10 percent by weight. Examples of specific terpolymers selected for the carrier include terpolymers of styrene, a diolefin containing, for example, from about 4 to about 6 carbon atoms, such as butadiene and/or isoprene, and a monoalkyl, or dialkyl amine, such as a dimethylaminoethyl methacrylate, diethylaminoethyl methacrylate, diisopropylaminoethyl methacrylate, or t-butylaminoethyl methacrylate; terpolymers of methylmethacrylate, such as those of methyl methacrylate, a diolefin containing from about 4 to about 6 carbon atoms, such as butadiene and/or isoprene and a monoalkyl, or dialkyl amine, such as a dimethylaminoethyl methacrylate, diethylaminoethyl methacrylate, diisopropylaminoethyl methacrylate, or t-butylaminoethyl methacrylate, and the like. Specific examples of polymer coatings are poly(styrene/butadiene/dimethyl aminoethyl methacrylate), poly(styrene/butadiene/tertiary-butylaminoethyl methacrylate), poly(styrene/butadiene/diethyl aminoethyl methacrylate), poly(styrene/butadiene/diisopropylaminoethyl methacrylate), terpolymers of styrene/butadiene, styrene/isoprene or styrene/2,3-dimethyl-1,3-butadiene with other monoalkyl or dialkylaminoethyl methacrylates, poly(methyl methacrylate/butadiene/dimethylaminoethyl methacrylate), poly(methyl methacrylate/butadiene/tertiary-butylaminoethyl methacrylate), poly(methyl methacrylate/butadiene/diethylaminoethyl methacrylate), poly(methyl methacrylate/butadiene/diisopropylaminoethyl methacrylate), terpolymers of methyl methacrylate/butadiene, methyl methacrylate/isoprene or methyl methacrylate/2,3-dimethyl-1,3-butadiene with other monoalkyl or dialkylaminoethyl methacrylates, wherein alkyl contains, for example, from about 1 to about 25, and preferably from 1 to about 10 carbon atoms, such as methyl, ethyl, n-propyl, butyl, isopropyl, pentyl, decyl, pentadecyl, eicosyl and pentacosyl, and the like with methyl, ethyl, and isopropyl being preferred.

The polymers, copolymers and terpolymers recited herein and other similar suitable polymers possess various suitable molecular weights, such as for example a weight average molecular weight of from about 20,000 to about 800,000, and a number average molecular weights of, for example, from about 12,000 to about 350,000 as measured by Gel Permeation Chromatography with preferred molecular weights $M_w$ of from about 30,000 to about 700,000 and number average molecular weights of from about 20,000 to about 300,000 as measured by Gel Permeation Chromatography.

The monomers for synthesizing the above polymers are obtained from Aldrich Chemical Company with regard to styrene, dimethylaminoethyl methacrylate, diethyl aminoethyl methacrylate, and methylmethacrylate, and Scientific Polymer Products with regard to diisopropylaminoethyl methacrylate and t-butylaminoethyl methacrylate. Synthetic methods for the preparation of polymers and copolymers from these monomers may be by bulk polymerization, solution polymerization, emulsion polymerization, suspension or semisuspension polymerization or any other known suitable polymerization methods.

The polymer coating may optionally have dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing. Alternatively, the process can incorporate one polymer, or mixture of polymers at the upstream feed port of the extruder, or other high shear melt-mixing device, and a second polymer, or mixture of polymers at a downstream feed port of the extruder. Optionally, a flow additive, a conductive additive, or mixtures thereof may be added at the downstream port, either singly, mixed together, or mixed with a polymer.

Moreover, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)] chromate(1-), ammonium sodium and hydrogen (TRH), cetyl pyridinium chloride (CPC), FANAL PINK® D4830, and the like, including those as specifically illustrated herein, and other effective known charge agents or additives. Specific negative charge additives, that is additives that assist in charging the toner to a negative polarity, are, for example, E-84™ zinc complex of 3,5-ditertiary butyl salicylic acid and E-88™ tris(3,5-di-tertiary butyl salicylato) aluminum, which are commercially available from Orient Chemical Company, TRH ammonium bis[1-(3,5-dinitro-2-hydroxy phenyl) azo-3-(N-phenylcarbamoyl)-2-naphthalenolate] chromate; U.S. Pat. No. 4,433,040, which is commercially available from Hodogaya Chemicals, aluminum complexes such as those disclosed in U.S. Pat. No. 5,324,613 and hydroxy bis(3,5-di-tertiary butyl salicylic) aluminate monohydrate disclosed in U.S. Pat. No. 5,223,368, the disclosures of each of these patents being totally incorporated herein by reference. The charge additives are selected in various effective amounts, such as from about 0.05 to about 15, and from about 0.1 to about 3 weight percent, based on the sum of the weights of all the toner components, such as the components of polymer, conductive additive, and charge additive components. Addition of various known charge enhancing additives can act to further increase the positive triboelectric charge imparted to the carrier, and therefore, further increase the negative triboelectric charge imparted to the toner in a xerographic development subsystem. A charge control agent with the carrier core and polymer may be introduced at the upstream feed port, or alternately, the polymer and core may be fed at the upstream feed port, and the charge control agent at the downstream feed port of an extruder.

Examples of second polymers selected can include polymethacrylates or acrylates, polyurethanes, fluorocarbon polymers, such as polyvinylidenefluoride, polyvinylfluoride, and polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. Nos. 4,937,166 and 4,935,326 patents mentioned herein.

Another second polymer is comprised of a thermosetting polymer, more specifically, a poly(urethane) thermosetting resin, which contains, for example, from about 75 to about 95, and preferably about 80 percent by weight of a polyester polymer, which, when combined with an appropriate crosslinking agent, such as isopherone diisocyannate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

Generally, the carrier conductivity is from about $10^{-6}$ to about $10^{-17}$ mho-cm$^{-1}$ and preferably $10^{-6}$ to about $10^{-8}$ mho-cm$^{-1}$ as measured for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Examples of advantages of the carriers of the present invention include in embodiments high robust carrier tribo charge of a positive value, high toner tribo charge of a negative value, excellent admix, for example, from about 1 to about 30 seconds as determined in the charge spectrograph, a smooth coating, an even coating, and the like.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected.

Colorants include dyes, pigments, mixtures thereof, mixtures of dyes, mixtures of pigments, and the like.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when about 8 to about 10 percent by weight of pigment, or colorant, such as carbon black like REGAL 330®, is contained therein, about 90 to about 92 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyans that may be used include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like can be selected. Known dyes may be selected such as food dyes and the like. These colorants, especially pigments are generally present in the toner composition in an amount of from about 1 weight percent to about 15, and for example, from about 2 to about 12 weight percent based on the weight of the toner components of binder and pigment.

For further enhancing, the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particles sizes and shapes are known and include for example a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits excellent chroma, superior color intensity, constant color chroma and intensity over extended time periods, such as 1,000,000 imaging cycles, and the like.

The following Examples are being provided to further illustrate the present invention, it being noted that these Examples are intended to illustrate and not limit the scope of the present invention. Parts and percentages are by weight unless otherwise indicated.

In all examples the triboelectric charge on the carrier particles was determined by the known Faraday Cage process. Further, the conductivity of the carrier was determined by forming a 0.1 inch long magnetic brush of the carrier particles, and measuring the conductivity by imposing a 10 volt potential across the brush.

COMPARATIVE EXAMPLE I

As a Comparative Example, a 65 micron average size conductive Hoeganaes steel core was coated in a 5 inch diameter kiln at 1.3 percent (weight percent) coating weight with a polymer comprised of 80 percent of polymethylmethacrylate containing 20 percent (percent by weight throughout) of SC Ultra conductive carbon black. The kiln does not contain a high shear impeller and thus the polymer coating was accomplished in the absence of high shear. A developer composition was then prepared by combining the above carrier with 4 percent by weight of a toner comprised 7 micron particle size (volume average diameter as determined by a Coulter Counter) cyan, 7 weight percent, and 93 weight percent of styrene/butylacrylate/acrylic acid toner. The above developer was conditioned at 20 percent relative humidity overnight, that is about 18 hours, then was charged by roll milling the developer for 30 minutes at 90 feet per minute in a 120 milliliter glass bottle. The triboelectric charge on the carrier particles was 21.3 microcoulombs per gram. Further, the conductivity of the carrier was $1.9\times10^{-8}$ $(\text{mho-cm})^{-1}$. Therefore, these carrier particles were conductive. The charge and conductivity are tabulated in the following Table and scanning electron microscope photographs evidenced uneven and uncoated portions of the carrier, and wherein in a non-metallized scanning electron microscopy the bright areas correspond to carrier core that is not coated by the coating, and the dark areas correspond to areas that are coated. Only about 57 to about 60 percent of the carrier was coated with polymer.

EXAMPLE II

A 65 micron average size Hoeganaes steel core was coated using a ZSK 30 extruder at 1.5 percent coating weight with the same polymer comprised of 80 percent of polymethylmethacrylate containing 20 percent of SC Ultra carbon black as utilized in Comparative Example I. The carrier core and polymer were first premixed by tumbling the core and the polymer for 45 minutes at room temperature. The ZSK-30 extruder was set with a temperature profile of 260/260/250/250/250/250/250/250° C. in the eight temperature control zones, while the counter-rotating screws of the extruder were running at a high rate, that is about 5 rpm and the feed rate of the polymer and core mixture at the input upstream port was 3.8 pounds per hour. The counter-rotating screws are the impellers that shear the carrier core mixture, and thus the polymer coating was accomplished in the presence of high shear. The high shear applied corresponded to a torque input of approximately 40 to 60 Newton-meters for much of the coating run, as determined by a torque sensor attached to the conveying screws of the extruder. The coated carrier was collected as it exited the end of the extruder through a 125 micron sieve, with a yield in excess of about 99, for example about 99.7, percent after passing through the sieve. The triboelectric charge on the resulting carrier particles was measured to be 22.5 microcoulombs per gram. Further, the conductivity of the carrier was determined $1.1\times10^{-6}$ $(\text{mho-cm})^{-1}$. Therefore, these carrier particles were more conductive than those of the Comparative Example I, with a somewhat higher charge. A scanning electron micrograph of the coated carrier indicated that the invention process of Example II generated a complete and even coverage of the carrier surface with about 95 to about 96 percent of the carrier surface being coated with polymer, whereas the processes of Comparative Example I, provided a very incomplete coverage of the carrier surface by the polymer, that is about 57 to about 60 percent of the coating on the carrier surface resulted.

| Example | Carrier Coating Process | Coating Polymer | Carrier q/m at 20% RH ($\mu$C/g) | Conductivity $\Omega^{-1}$ cm$^{-1}$ |
|---|---|---|---|---|
| Comparative Example I | Kiln, | 80% PMMA/ 20% Carbon Black | 21.3 | $1.9 \times 10^{-8}$ |
| Example II | ZSK 30 Extruder | 80% PMMA/ 20% Carbon Black | 22.5 | $1.1 \times 10^{-6}$ |

COMPARATIVE EXAMPLE III

As a second Comparative Example, a 65 micron average size conductive Hoeganaes steel core was coated in a 7 inch diameter kiln with no impellers and thus the absence of high shear mixing at 1.5 percent coating weight with a polymer comprised of polymethylmethacrylate. A developer composition was then prepared as in Comparative Example I. The above developer was conditioned and charged as in Comparative Example I, except that the relative humidity was 50 percent and the charging was accomplished on a paint shaker for 1 minute, 15 minutes, and 90 minutes, with a developer sample taken at each point. Thereafter, the triboelectric charge on the carrier was measured for each of these developers. At 15 minutes of charging the charge was 38 microcoulombs per gram. Further, the conductivity of the carrier was measured, as in Comparative Example I to be $3.6\times10^{-14}$ $(\text{mho-cm})^{-1}$. Therefore, these carrier particles were insulative. Also, the carrier coating was incomplete and similar to the above Comparative Example, that is only about 60 percent of the carrier was coated with polymer as evidenced by scanning electron information.

EXAMPLE IV

A 65 micron average size Hoeganaes steel core was coated using a ZSK 30 extruder at 1.0 percent coating weight with the same Soken polymethacrylate polymer utilized in Comparative Example III. Ten pounds of carrier core and coating polymer were mixed for 30 minutes at 27 rpm with a Littleford M5 mixer. The extruder temperature profile was 260/2601260/230/205/205/205/205° C. in the eight control zones of the extruder, while the counter-rotating screws of the extruder were running at 14 rpm and the feed rate of the polymer core mixture at the input upstream port was 10.5 pounds per hour. The counter-rotating screws are the impellers that shear the carrier core mixture, and thus the polymer coating was accomplished in the presence of high shear as indicated in Example II above. The triboelectric charge on the carrier particles was measured to be 45 microcoulombs per gram at 15 minutes of charging. The aging stability of the carrier coating was excellent at 1, 15 and 90 minutes of paint shake mixing. The charging of the carrier coated with high shear in Example IV is higher charge than carrier coated in kiln. Further, the conductivity of the carrier was $9.4\times10^{-16}$ $(\text{mho-cm})^{-1}$. About 97 percent of the resulting carrier was coated with polymer resulting, for example, in embodiments in higher tribo charge and a lower conductivity.

EXAMPLE V

A 65 micron average size Hoeganaes steel core was coated using a ZSK 30 extruder at 0.5 percent coating weight with the same Soken polymethacrylate polymer utilized in Comparative Example III. Ten pounds of carrier core and coating polymer were mixed for 30 minutes at 27 rpm with a Littleford M5 mixer. The extruder was set with a temperature profile of 260/2601260/230/200/200/200/200° C. in the eight control zones of the extruder, while the counter-rotating screws of the extruder were operating at 14 rpm and the feed rate of the polymer core mixture at the input upstream port was 10.2 pounds per hour. The counter-rotating screws are the impellers that shear the carrier core mixture, and thus the polymer coating was completed the presence of high shear as indicated in Example II. The triboelectric charge on the carrier particles was measured to be 42 microcoulombs per gram with 15 minutes of paint shake charging. Compared to the Comparative Example III the charge of the carrier of Example V was higher at all times, and the aging rates were similar. Further, the conductivity of the generated carrier was $7.3\times10^{-15}$ (mho-cm)$^{-1}$, more insulative than the Comparative Example III. Also, the carrier particles of this Example V and coated with high shear were more almost completely coated, about 97 percent, by the insulative polymer coating compared to the about 60 percent of Comparative Example III, although the coating weight was only one-half of that in Comparative Example III. Thus, for example, excellent coating coverage was achieved at lower coating weights of the polymer.

EXAMPLE VI

A 65 micron average size Hoeganaes steel core was coated using a ZSK 30 extruder at 0.3 percent coating weight with the same Soken polymethacrylate polymer utilized in Comparative Example III. Ten pounds of carrier core and the PMMA coating polymer were mixed for 30 minutes at 27 rpm with a Littleford M5 mixer. The extruder was set with a temperature profile of 260/260/260/230/200/200/2001200° C. in the eight control zones of the extruder, while the counter-rotating screws of the extruder were operating at 14 rpm and the feed rate of the polymer core mixture at the input upstream port was 10.2 pounds per hour. The counter-rotating screws are the impellers that shear the carrier core mixture, and thus the polymer coating is accomplished in the presence of high shear as illustrated in Example II. The triboelectric charge on the carrier particles was measured to be 36 microcoulombs per gram at 15 minutes of paint shaking. Further, the conductivity of the carrier was $4.0\times10^{-14}$ (mho-cm)$^{-1}$. Therefore, these carrier particles were somewhat more insulative than those of the Comparative Example III, with a lower charge. The results indicate that the generated carrier of this Example VI has a very similar coating coverage, about 95 percent, of the carrier ng compared to Comparative Example III. Thus, as illustrated by the inventive carriers of Examples IV, V and VI, the coating of the carrier with an insulative polymer, in the presence of high shear usually results in a higher charge and lower conductivity, indicative of a more complete coating, for example about 95 to about 97 percent, of the carrier core at the same coating weight, or wherein equivalent coatings can be achieved with only 30 percent of coating polymer.

| Carrier ID | Carrier Coating Process | Coating Polymer | Coating Weight (%) | Carrier Q/M at 50% RH ($\mu$C/g) | Conductivity $\Omega^{-1}$ cm$^{-1}$ |
|---|---|---|---|---|---|
| Comparative Example III | Kiln | Soken PMMA | 1 | 38 | $3.6\times10^{-14}$ |
| Example IV | ZSK 30 | Soken PMMA | 1 | 45 | $9.4\times10^{-16}$ |
| Example V | ZSK 30 | Soken PMMA | 0.5 | 42 | $7.3\times10^{-15}$ |
| Example VI | ZSK 30 | Soken PMMA | 0.3 | 36 | $4.0\times10^{-14}$ |

COMPARATIVE EXAMPLE VII

Thirty, 30 micron average size Strontium Ferrite core obtained from PowderTech was coated in a 5 inch diameter kiln at 5 percent coating weight with a polymer comprised of 81 percent polymethylmethacrylate and dispersed therein 19 percent of the conductive carbon black SC Ultra carbon black. The charging of the resulting 30 micron average was measured by preparing a developer composition as in Comparative Example III, excepting that the sample was prepared at 10 percent toner concentration with a styrene/acrylate (90 percent) cyan (10 percent cyan pigment) toner of particle size of 7 microns, and was charged on the paint shaker for 10 minutes. The measured triboelectric charge on the carrier was measured to be 14.7 microcoulombs per gram.

EXAMPLE VIII

The 30 micron Strontium Ferrite core utilized in Comparative Example VII was coated at 5 percent coating weight with a polymer comprised of 80 percent polymethylmethacrylate and there was dispersed therein 20 percent of the conductive carbon black SC Ultra carbon black. The coating was accomplished by blending 120 grams of core and 6 grams of the coating polymer by tumbling for 45 minutes, then melt-mixing on a Haake System 90 Torque Rheometer model number 600, fitted with conveying screws, at a high mixing rate of 30 rpm with a temperature profile of 190° C. for 5 minutes, then for 25 minutes at 170° C. By the procedure described in Comparative Example VII the triboelectric charge on the resulting carrier particles was measured to be 25.9 microcoulombs per gram. The higher charge of the carrier particles than that of the Comparative Example VII indicates that the polymer has effectively coated, about 94 percent, the surface of the core particles and resulting in above measured higher charge.

EXAMPLE IX

The 30 micron Strontium Ferrite core from Comparative Example VII was coated at 5 percent coating weight with a polymer comprised of 80 percent polymethylmethacrylate and dispersed therein 20 percent of SC Ultra carbon black. The coating was accomplished by first preblending 10 pounds of the above carrier and core mixture for 30 minutes at 50 rpm with a Littleford M5 mixer, then melt-mixing on a ZSK 30 extruder fitted with conveying screws, with the conveying screws turning at a high speed of about 30 rpm, and with the eight control zones of the extruder set with a temperature profile of 260/260/1601180/1601140/140/140° C. for 5 minutes, then for 25 minutes at 190° C. The preblended carrier was fed into the upstream feed port at a rate of 6.6 pounds per hour. The triboelectric charge on the carrier particles was measured to be 30.6 microcoulombs per gram. Therefore, these carrier particles possessed a higher charge than the Comparative Example VII at the same coating weight. The results evidence that the carrier of Example IX was much more completely coated, about 95 percent, by accomplishing the polymer coating in the presence of high shear; as compared to about 60 percent for Comparative Example VII.

Coated 30 Micron Carrier Core

| ID | Process | Coating Resin | CW % | Carrier Q/M 50% RH |
|---|---|---|---|---|
| Comparative Example VII | Kiln | 81% PMMA/19% Carbon Black | 5.0 | 14.7 |
| Example VIII | ZSK 30 | 80% PMMA/20% Carbon Black | 5.0 | 25.9 |
| Example IX | Haake | 80% PMMA/20% Carbon Black | 5.0 | 30.6 |

Other embodiments and modifications of the present invention may occur to those of ordinary skill in the art subsequent to a review of the present application and the information presented herein; these embodiments and modifications, as well as equivalents thereof, are also included within the scope of the present invention.

What is claimed is:

1. A process for the preparation of carrier comprised of mixing in a high shear device a carrier core and a carrier coating, and wherein said high shear device contains impellers.

2. A process in accordance with claim 1 wherein the coating is a polymer.

3. A process in accordance with claim 1 wherein the coating is comprised of a mixture of polymers.

4. A process in accordance with claim 1 wherein the coating is a styrene polymer.

5. A process in accordance with claim 1 wherein the coating is a fluoropolymer.

6. A process in accordance with claim 1 wherein the coating is a styrene acrylic.

7. A process in accordance with claim 1 wherein the coating is a styrene methacrylic.

8. A process in accordance with claim 1 wherein the coating is polymethylmethacrylate.

9. A process in accordance with claim 1 wherein the polymer coating weight is from about 0.1 to about 20 weight percent, and the carrier size is from about 30 to about 200 microns in volume average diameter.

10. A process in accordance with claim 1 wherein the polymer coating weight is from about 0.3 to about 20 weight percent.

11. A process in accordance with claim 1 wherein the polymer contains a conductive component.

12. A process in accordance with claim 11 wherein the conductive component is a metal oxide, or is carbon black.

13. A process in accordance with claim 1 wherein the carrier conductivity ranges from about $10^{-15}$ mho/cm to about $10^{-6}$ mho/cm, or from about $10^{-8}$ to about $10^{-6}$ mho/cm.

14. A process in accordance with claim 1 wherein said core is a metal, a metal oxide, a ferrite, or mixtures thereof.

15. A process in accordance with claim 1 wherein the carrier core is a strontium ferrite.

16. A process for the preparation of a developer comprising mixing the carrier of claim 1 and toner.

17. A process in accordance with claim 16 wherein the toner is comprised of thermoplastic resin and colorant.

18. A process in accordance with claim 17 wherein the colorant is a pigment, or a dye.

19. A process in accordance with claim 1 wherein said carrier coating is comprised of a first and second polymer.

20. A process in accordance with claim 19 wherein the second polymer is a fluoropolymer, a styrene polymer, a styrene acrylate copolymer, or a styrene methacrylate copolymer.

21. A process in accordance with claim 19 wherein said second polymer is comprised of a polyurethane, or polymethylmethacrylate.

22. A process in accordance with claim 1 wherein said core is a metal of spherical steel or atomized steel, a metal oxide of magnetite, a ferrite of Cu/Zn-ferrite, Ni/Zn-ferrite, Sr (strontium)-ferrite, or Ba-ferrite.

23. A process in accordance with claim 1 wherein said coating is comprised of a mixture of polymers.

24. A process in accordance with claim 23 wherein said mixture contains from about 2 to about 7 polymers.

25. A process in accordance with claim 23 wherein said mixture is comprised of two polymers.

26. A process in accordance with claim 25 wherein said polymers are polymethylmethacrylate and polyvinylidene fluoride.

27. A carrier obtained by the process of claim 1.

28. A process in accordance with claim 1 wherein said high shear device is an extruder, and wherein said high shear corresponds to a torque input of about 40 to about 60 Newton-meters.

29. A process in accordance with claim 28 wherein said extruder contains conveying screws, and which screws are operating at a high speed of about 30 revolutions per minute.

30. A process in accordance with claim 1 wherein there are obtained smooth coatings on said carrier, and substantially complete coating of the carrier core.

31. A process for the preparation of carriers comprised of premixing carrier cores and carrier coatings and thereafter mixing in a high shear device said carrier cores and carrier coatings and wherein said high shear device contains impellers.

32. A process in accordance with claim 31 wherein said device is a high shear mixer.

33. A process in accordance with claim 32 wherein said high shear mixer is a Haake melt mixer or an extruder.

34. A process in accordance with claim 32 wherein said high shear mixer is a Banbury mixer.

35. A process in accordance with claim 32 wherein said high shear mixer is a mixing device containing conveying screws.

36. A process in accordance with claim 32 wherein said high shear mixer is a mixing device with an impeller.

37. A process in accordance with claim 32 wherein said high shear mixer is operating at from about 5 to about 150 rpm.

38. A process in accordance with claim 3 wherein said high shear mixer is operating at from about 5 to about 150 rpm, and wherein the mixture is heated at a temperature of from about 100 to about 500° C.

39. A process in accordance with claim 32 wherein said high shear mixer is operating at from about 5 to about 150 rpm, and wherein the mixture is heated at a temperature of from about 100° C. to about 500° C. followed by separating the resulting coated carrier.

40. A process in accordance with claim 32 wherein said high shear mixer is operating at from about 5 to about 150 rpm, and wherein the mixture is heated at a temperature of from about 100° C. to about 500° C. followed by separating the resulting coated carrier and which carrier is at a temperature of from about 50° C. to about 400° C.

41. A process in accordance with claim 32 wherein said high shear mixer is operating at from about 5 to about 150 rpm, and wherein the mixture is heated at a temperature of from about 100° C. to about 500° C. followed by separating the resulting coated carrier and which carrier is at a temperature of from about 50° C. to about 400° C.; thereafter subjecting the coated carrier to sieving and wherein the sieve size is from about 50 to about 300 microns in diameter.

42. A process in accordance with claim 41 wherein said sieve size is from about 50 to about 150 microns in diameter.

43. A process for the preparation of carrier consisting essentially of mixing in a high shear device a carrier core and a carrier coating, and wherein said high shear device contains impellers.

44. A process for the preparation of carrier consisting essentially of mixing in a high shear device a carrier core and a carrier coating, and wherein said high shear device is an extruder.

45. A process in accordance with claim 44 wherein said high corresponds to a torque input of approximately 40 to 60 Newton-meters.

* * * * *